US005931531A

United States Patent [19]

Assmann

[11] Patent Number: 5,931,531

[45] Date of Patent: Aug. 3, 1999

[54] CHAIR HAVING ADJUSTABLE SYNCHRONOUS TILTING

[75] Inventor: Jörg Assmann, Rietberg, Germany

[73] Assignee: Comforto GmbH, Ahlen, Germany

[21] Appl. No.: 09/157,878

[22] Filed: Sep. 21, 1998

Related U.S. Application Data

[63] Continuation-in-part of application No. PCT/EP98/00342, Jan. 22, 1998.

[30] Foreign Application Priority Data

Jan. 23, 1997 [DE] Germany ..... 197 02 328

[51] Int. Cl.[6] ..... A47C 3/00

[52] U.S. Cl. ..... 297/316; 297/320; 297/300.2; 297/301.76; 297/300.7

[58] Field of Search ..... 297/316, 320, 297/300.1, 300.2, 300.3, 300.8, 301.6, 301.7, 300.4, 300.5, 300.6, 300.7, 340

[56] References Cited

U.S. PATENT DOCUMENTS

| | | | |
|---|---|---|---|
| 2,272,980 | 2/1942 | McLellan et al. | 297/301.6 |
| 2,859,799 | 11/1958 | Moore | 297/300.5 |
| 4,596,421 | 6/1986 | Schmitz | 297/316 |
| 5,150,948 | 9/1992 | Volkle | 297/300.5 |
| 5,308,144 | 5/1994 | Korn | 297/320 |
| 5,423,594 | 6/1995 | Hancock et al. | 297/300.2 |
| 5,560,682 | 10/1996 | Brown | 297/316 |
| 5,826,940 | 10/1998 | Hodgon | 297/316 |

*Primary Examiner*—Peter M. Cuomo
*Assistant Examiner*—Anthony D. Barfield
*Attorney, Agent, or Firm*—Alix, Yale & Ristas, LLP

[57] ABSTRACT

A chair having adjustable synchronous tilting, where a seat (7) pivotable about a seat pivot axis (5) and a back-rest support (11) pivotable about a back-rest pivot axis (9) are coupled by a coupling link (15) for simultaneous inclination changes, the synchronous tilting ratio, i.e. the ratio of the coupled inclination changes of seat and back-rest can be changed and individually adjusted, for example by displacing the engagement points of the coupling link (15) at the seat (7) and the back-rest support (11), respectively.

5 Claims, 1 Drawing Sheet

CHAIR HAVING ADJUSTABLE SYNCHRONOUS TILTING

This is a continuation in part of co-pending International Application PCT/EP98/00342 which was filed on Jan. 22, 1998. This continuation in part claims priority from German patent 197 02 328.2 which was filed on Jan. 23, 1997.

BACKGROUND OF THE INVENTION

The invention relates to a chair having synchronous tilting. The term synchronous tilting is intended to mean the use of a coupling linkage between the seat and the back-rest which has the effect that any change of inclination of the back-rest is automatically combined with the change of inclination of the seat, and vice versa. This provides improved seating comfort for the user since it is desirable to have a substantially horizontal position of the seat in case of upright position of the back and a rearwardly inclined position of the seat in case of a rearwardly inclined position of the back.

Chairs having synchronous tilting have been known in numerous embodiments, and the documents DE 30 33 953 C2, DE 36 08 718 C3 and DE 38 34 614 A1 can be cited as examples. The ratio between the coupled inclination changes of the seat and the back-rest, i.e. the so-called synchronous tilting ratio, is determined by the mutual distances of the pivot axis and the linkage pivots.

In the aforementioned prior art chairs having synchronous tilting, the aforementioned ratio or synchronous tilting movement is fixed by the construction geometry and not variable. Adjustments, for example to physical conditions of the user such as to his or her body weight, may be possible by adjusting a spring force counteracting the change of inclination (cf. De 36 08 718 C2 or DE 37 00 447 A1) or by adjusting the inclination of the seat in its normal position (cf. DE 43 24 545 A1, FIG. 6).

U.S. Pat. No. 5,423,594 to Hancock et al. discloses a chair having synchronous tilting wherein the synchronous tilting ratio can be changed by changing the length of a link connecting the back-rest support with the base structure of the chair. Changing the length of the link also changes the angle between the back-rest and the seat in the normal position of the chair. It is not possible to change the synchronous tilting ratio, i.e. the ratio of the coupled inclination changes of seat and back-rest, without at the same time also changing the angle between the seat and the back-rest in the normal position.

U.S. Pat. No. 5,560,682 to Brown discloses a chair having synchronous tilting where the synchronous tilting ratio can be changed by changing the geometry of a linkage connecting the back-rest support with the base structure of the chair. Such change of geometry is, however, only possible by replacing parts of said linkage. In this case, too, not only the synchronous tilting ratio of the coupled inclination changes of seat and back-rest is changed, but also the angle formed between seat and back-rest in the normal position.

DE-A-3700447 discloses a chair which can optionally be obtained with or without synchronous tilting depending on whether a coupling link is connected between the seat support and back-rest support or between the seat and the base structure of the chair. The choice between these two positions of the link must be made at the factory; any adjustment by the user is not provided.

BRIEF SUMMARY OF THE INVENTION

It is an object of the invention to provide a chair of the above mentioned type in which the synchronous tilting ratio, i.e. the ratio between the coupled inclination changes of seat and back-rest can be changed by the user in a simple manner without at the same time changing the angle formed between the seat and the back-rest in the normal position.

The basic concept of the invention is to be able to adjust the ratio between the coupled inclination changes of the seat and the back-rest not by changing the effective length of a link connecting the seat and the back-rest, but by displacing said link relative to the pivot axes of seat and back-rest. Since the pivot mountings of the link are slidably guided in slots of the seat and the back-rest support and these slots are substantially parallel to each other in the normal position of the chair, the displacement of the link in these slots will not change the inclination of the back-rest relative to the seat in the normal position, but only the ratio between the changes of inclination of back-rest and seat.

BRIEF DESCRIPTION OF THE DRAWING

The drawing shows a schematic side view of an office chair having adjustable synchronous tilting according to an embodiment of the invention.

DESCRIPTION OF THE PREFERRED EMBODIMENT

Figure 1:
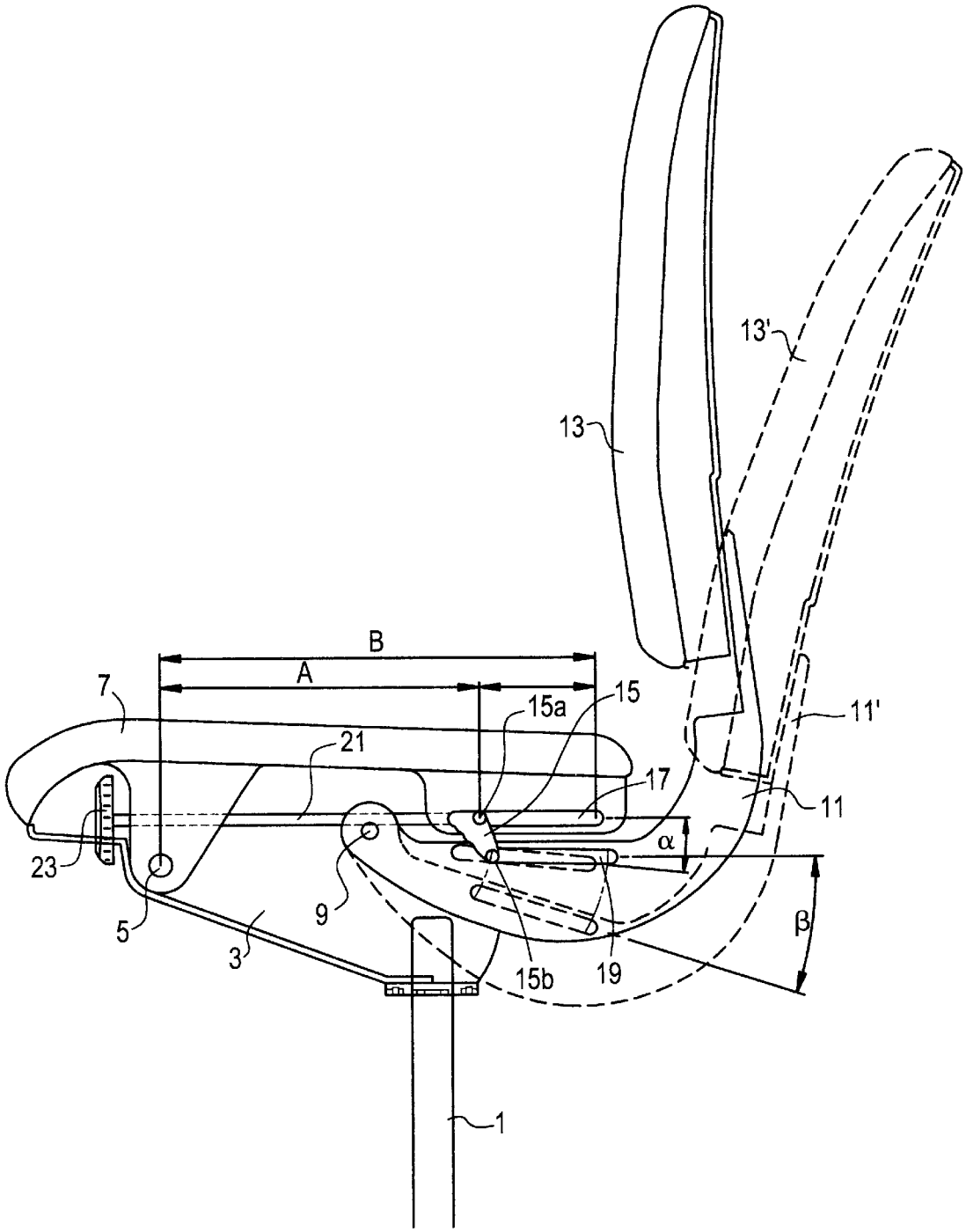

The preferred embodiment of the invention will be further explained in detail with reference to the drawing. A base support 3 is rotatably and height-adjustably mounted to a chair column 1 in a manner known per se. In the forward part of the seat support 3 a seat 7 is pivotably mounted about a horizontal axis 5. This seat pivot axis 5 is preferably located below the front portion of the seat 7. Spaced to the rear from pivot axis 5 a second horizontal pivot axis 9 is formed at the seat support 3 for pivotably mounting a back-rest support 11 which carries a back-rest 13. The back-rest support 11 is coupled with the seat 7 by a coupling link 15. For this purpose the coupling link 15 has an upper pivot pin 15*a* which engages in a substantially horizontal slot 17 of the seat 7, and a lower pivot pin 15*b* which engages in a substantially horizontal slot 19 of the backrest support 11. The pivot pins 15*a,* 15*b* are slidable in slots 17, 19 and the position of the coupling link 15 in the longitudinal direction of the slots 17, 19 can be adjusted and fixed by means of a lead screw 21 which is mounted to the seat support 7 and can be rotated by the user by means of a hand wheel 23.

It would be readily understood by those skilled in the art that the coupling link 15 with its pivot pins 15*a* and 15*b* as well as the slots 17, 19 can be provided as a pair on both sides of the vertical center plane of the chair. Alternatively they can be provided only once in the center plane of the chair.

By rotating the lead screw 21 the coupling link 15 can be displaced in the longitudinal direction of the slots 17, 19, whereby the distance of the link axes provided by pivot pins 15*a,* 15*b* from the seat pivot axis 5 and back-rest pivot axis 9 can be changed. In the drawing the coupling link 15 is shown in its left position which is the forward end position in which the pivot pin 15*a* has the smallest possible distance A from the pivot axis 5 of seat 7. With this position of coupling link 15, if the back-rest support 11, with the back rest 13, is tilted from its normal or most forward position shown in full lines, backward by an angle $\beta$ into the position 11' shown in broken lines, the seat 7 due to its coupling to the back-rest support 11 through the coupling link 15 will be tilted downward from its normal position by an angle $\alpha$. The ratio between the angles $\alpha$ and $\beta$ depends on the distance of the coupling link 15 from the pivot axes 5 and 9. In the left end position of the coupling link 15 as shown in the drawing, a backward tilting of the back-rest from its normal or forward position by a given angle β will result in the smallest possible tilting angle α of the seat, which means that the ratio of the seat tilting angle α to the back-rest tilting angle β, the so-called synchronous tilting ratio, will have the smallest possible value. In the embodiment shown as an example this ratio will be ca. 0.4:1.

If the coupling link 15 is displaced by means of the lead screw 21 to the right in the drawing, so that the pivot pin 15*a* reaches the right hand end or rear end of the slot 17 and has the maximum distance B from the pivot axis 5 of the seat 7, a backward tilting of the back-rest support 11 by the same angle β will have the effect that the coupling link 15 will draw the seat 7 downward by an angle α' (not shown) which is substantially greater than the angle α as shown in the drawing. This means that the ratio of the angle α' to the angle β has a greater value. In the embodiment as shown the synchronous tilting ratio in the right hand end position of the coupling link 15 would be ca. 0.7:1.

Since the slots 17, 19 are substantially parallel to each other when the seat 7 and back-rest support 11 are in the normal position, the displacement of the coupling link 15 along these slots 17, 19 by means of the lead screw 21 will not cause the angle formed between the back-rest and the seat in the normal position to change. It is thus possible for the user to adjust the synchronous tilting ratio of the coupled inclination changes of the seat and the back-rest in the normal position. Additional independent means (not shown) may be provided to independently change and adjust the angle between the back-rest and the seat in the normal position of the chair.

It should be understood that the drawing only shows a schematic example. Many details not necessary for the invention have been omitted, for example any springs or the like which generate the necessary counter-force to the tilting movement of the seat 7 and the back-rest support 11 for providing a restoring force which brings the seat and back-rest back into the normal position.

Within the scope of the invention the displacement of the link 15 connecting the seat 7 and the back-rest support 11 relative to the pivot axes 5 and 9 thereof could also be obtained by any other mechanical arrangement other than by means of guide slots and a lead screw. Moreover, an adjustment means using electric power might be considered instead of a mechanical adjusting means. The adjustment could also be made in a number of predetermined adjusting steps rather than as a continuous adjustment. Moreover, a change of the synchronous ratio could also be obtained by displacing the pivot axes 5, 9 of the seat and the back-rest relative to the coupling link 15.

In the preferred embodiment, the seat 7 and the back-rest support 11 are shown to be pivotably mounted to the base support by means of respective pivot pins 5, 9 each forming a physical pivot axis. However, the seat 7 and/or the back-rest support 11 might also be mounted to the base support 3 by means of links which control the movement of the seat 7 and/or back-rest support 11 relative to the base support 3 by a pivotal movement about an imaginary pivot axis.

What is claimed is:

1. A chair having adjustable synchronous tilting, comprising:

a base support;

a seat having a means for pivotably mounting said seat to said base support about a horizontal seat pivot axis, said seat having a normal position and a tilted position which define a first pivot angle, said seat having at least one guide means that is substantially horizontal when said seat is in said normal position;

a back rest support having a means for pivotably mounting said back rest support to said base support about a horizontal back rest support pivot axis, said back rest support having a normal position and a tilted position which define a second pivot angle, said back rest support having at least one guide means that is substantially horizontal when said back rest support is in said normal position;

wherein a synchronous tilting ratio is defined by the ratio between said first pivot angle and said second pivot angle;

a back rest which is attached to said back rest support;

at least one coupling link means, each said coupling link means having an upper pivot engaging at least one said seat guide means, said upper pivot being displaceably guided in said seat guide means, and a lower pivot engaging at least one said back rest support guide means, said lower pivot being fixed in relation to said upper pivot and displaceably guided in said back rest support guide means;

at least one adjusting means for displacing and fixing a position of said coupling link upper pivot along said seat guide means and said coupling link lower pivot along said back rest support guide means; and a means for urging said seat and said back rest support toward said normal position from said tilted position;

wherein said synchronous tilting ratio is adjustably determined by the displacement of said seat pivot axis and said back rest support pivot axis from said coupling link upper pivot engagement and said coupling link lower pivot engagement, respectively, as established by said adjustment means.

2. A chair having adjustable synchronous tilting as in claim 1, wherein:

said adjustment means, said seat guide means and said back rest support guide means are chosen to provide a range of displacement of said coupling link upper pivot along said seat guide means and said coupling link lower pivot along said back rest support guide means relative to said seat pivot axis and said back rest support pivot axis so that said synchronous tilting ratio is 0.4:1 at one end of said displacement range and 0.7:1 at the other end of said displacement range.

3. A chair having adjustable synchronous tilting, comprising:

a base support;

a seat pivotably mounted to said base support about a physical or imaginary horizontal seat pivot axis, said seat having a normal position and a tilted position which define a first pivot angle, said seat having at least one slot that is substantially horizontal when said seat is in said normal position;

a back rest support pivotably mounted to said base support about a physical or imaginary horizontal back rest pivot axis, said back rest support having a normal position and a tilted position which define a second pivot angle, said back rest support having at least one slot that is substantially horizontal when said back rest is in said normal position;

wherein a synchronous tilting ratio is defined by the ratio between said first pivot angle and said second pivot angle;

a back rest which is attached to said back rest support;

at least one coupling link, each said coupling link having an upper pivot engaging at least one said seat slot, said upper pivot being displaceably guided in said seat slot and a lower pivot engaging at least one said back rest support slot, said lower pivot being fixed in relation to said upper pivot and displaceably guided in said back rest support slot; and at least one adjusting means for displacing and fixing said coupling link upper pivot along said seat slot and said coupling link lower pivot along said back rest support slot;

wherein said synchronous tilting ratio is determined by the displacement of said seat pivot axis and said back rest support pivot axis from said coupling link upper pivot engagement and lower pivot engagement, respectively, as established by said adjustment means.

4. A chair having adjustable synchronous tilting as in claim 3, wherein:

said adjusting means comprises a lead screw assembly.

5. A chair having adjustable synchronous tilting as in claim 3, wherein:

said adjustment means, said seat slot and said back rest support slot are chosen to provide a range of displacement of said coupling link upper pivot along said seat slot and said coupling link lower pivot along said back rest support slot relative to said seat pivot axis and said back rest support pivot axis so that the synchronous tilting ratio is 0.4:1 at one end of said displacement range and 0.7:1 at the other end of said displacement range.

* * * * *